US006945051B2

(12) United States Patent
Benelli et al.

(10) Patent No.: US 6,945,051 B2
(45) Date of Patent: Sep. 20, 2005

(54) LOW NOX EMISSION DIFFUSION FLAME COMBUSTOR FOR GAS TURBINES

(75) Inventors: Giancarlo Benelli, San Miniato (IT); Luciano Carrai, Rosignano Marittimo (IT); Davide Cecchini, Livorno (IT); Giordano Tanzini, Pisa (IT)

(73) Assignee: Enel Produzione S.p.A., Rome (IT)

( * ) Notice: Subject to any disclaimer, the term of this patent is extended or adjusted under 35 U.S.C. 154(b) by 0 days.

(21) Appl. No.: 10/290,972

(22) Filed: Nov. 8, 2002

(65) Prior Publication Data

US 2003/0089111 A1 May 15, 2003

(30) Foreign Application Priority Data

Nov. 9, 2001 (IT) ..... FI2001A0211

(51) Int. Cl.[7] ..... F23R 3/14; F02C 3/00
(52) U.S. Cl. ..... 60/737; 60/742; 60/748
(58) Field of Search ..... 60/742, 748, 737, 60/39.463, 755, 756

(56) References Cited

U.S. PATENT DOCUMENTS

| | | | | | |
|---|---|---|---|---|---|
| 2,974,485 | A | * | 3/1961 | Schiefer | 60/756 |
| 3,777,983 | A | * | 12/1973 | Hibbins | 60/742 |
| 3,866,413 | A | * | 2/1975 | Sturgess | 60/742 |
| 3,916,619 | A | * | 11/1975 | Masai et al. | 60/756 |
| 5,657,632 | A | * | 8/1997 | Foss | 60/737 |
| 6,161,387 | A | * | 12/2000 | Green | 60/748 |
| 6,367,262 | B1 | * | 4/2002 | Mongia et al. | 60/748 |
| 2002/0162333 | A1 | | 11/2002 | Zelina | 60/776 |

FOREIGN PATENT DOCUMENTS

| | | | |
|---|---|---|---|
| EP | 0500256 | 8/1992 | F23R/3/14 |
| EP | 1193448 | 4/2002 | F23R/3/28 |
| EP | 1193449 | 4/2002 | F23R/3/28 |
| EP | 1225392 | 7/2002 | F23R/3/28 |

* cited by examiner

*Primary Examiner*—Ted Kim
(74) *Attorney, Agent, or Firm*—Pollack, P.C.; Grant E. Pollack

(57) ABSTRACT

A diffusion flame combustor for a gas turbine comprising a flame tube that delimits a combustion chamber, the flame tube having a fuel injector unit mounted at one end, the other end of the tube being connected to a duct that conveys combustion gases to the turbine. The flame tube is mounted coaxially inside a generally tubular container that communicates with the discharge casing of an air compressor and, together with the tube, defines a space for combustion air. The injector unit comprises an injector head facing generally into the combustion chamber and provided with at least one fuel gas injection nozzle. The nozzle includes an air-gas premixing duct into which fuel gas is introduced. The premixing duct has an inlet section that communicates with the air space and is provided with a radial-fin air swirler generally upstream of a point at which the fuel gas enters the premixing duct. This partial premixing of combustion gas with combustion air reduces $NO_x$ emissions and production of un-combusted material.

5 Claims, 3 Drawing Sheets

LOW NOX EMISSION DIFFUSION FLAME COMBUSTOR FOR GAS TURBINES

FIELD OF THE INVENTION

The present invention relates generally to pollution control and, more particularly, to an arrangement for reducing emissions from a diffusion flame combustor for a gas turbine or the like.

BACKGROUND OF THE INVENTION

Conventional diffusion flame combustors for gas turbines typically comprise a fuel injector unit mounted at one end of a flame tube that delimits a combustion chamber. The other end of the tube is connected to a duct for conveying combustion gas to the turbine blades. The flame tube is mounted coaxially within a tubular container that is in communication with a combustion air compressor discharge casing and, together with the flame tube, defines a space for combustion air, or air space. The injector unit is mounted so as to have its head inside the combustion chamber and is provided, in a two-fuel version, for example, with an axial atomizer nozzle for the liquid fuel and, around it, an annular injector nozzle or a crown of nozzles for injection of the gaseous fuel. The air arriving from the air space is conveyed into the combustion chamber independently of the injector unit. Holes appropriately distributed along the flame tube are provided for input of primary, secondary and dilution air.

Although useful, a simple-cycle gas turbine engine of this type, which is presently used throughout the electric power industry to accommodate peak energy generation needs, often has emission levels too high for those pollution standards or limits of many power generation locations and, therefore, can be subjected to operating power limitations or prohibitions at many sites. Worldwide there are thousands of gas turbine engines in operation for providing peak load services. While typically the gas and oil firing NOx (nitrogen oxides) emissions produced, at maximum load engine conditions, are approximately 0.17 and 0.3 Kg/Mcal, respectively, such emission levels are frequently above those permitted by law. Moreover, in many countries, average NOx emission are below about 0.13 Kg/Mcal; and in the next few years a further reduction in emission standards to about 0.065 Kg/Mcal or even lower is anticipated. Accordingly, it has usually been necessary to average the NOx emissions produced by gas turbine engines with other sources operating well below the system-wide emission limits in order to achieve compliance.

In a gas turbine combustor, NOx emissions are essentially generated by two mechanisms:

1) Primary mechanism: namely, by fixation of atmospheric nitrogen in the flame (thermal NOx);
2) Secondary mechanism: that is, by conversion of nitrogen chemically bound in the fuel (chemical NOx), as in some lower quality heavy fuel oils, process gases and some coal gases from gasifiers with hot gas clean up.

According to the Zeldovich mechanism, the rate at which thermal NOx is formed increases exponentially with the flame temperature and linearly with the time the combustion gas remains at the flame temperature. Consequently, the peak flame temperature and the retention time are the principal variables that control NOx formation and the resulting emission levels. Furthermore, the rate at which nitrogen oxides are formed diminishes rapidly when the flame becomes poor in fuel and as the peak temperature diminishes. Therefore, introduction of small quantities of diluents into the primary combustion zone has the effect of reducing the rate of thermal NOx formation.

Consequently, to maintain old gas turbine engines in operation when more stringent emission limits are required, the following possible options must be considered:

a) installing water or steam injection systems on gas turbine engines to achieve between 40% and 50% NOx reduction of actual emission values. This option requires additional equipment and increases operating costs due to loss of engine efficiency caused by the relatively high water/fuel ratios utilized;
b) installing sophisticated and relatively expensive dry low-NOx combustion systems that also require considerable modifications to the engine control equipment, if such are based on multistage premixed combustion processes;
c) retrofitting combustion systems with minor modifications for achieving both low NOx emission levels and low impact on the engines.

In order to make emissions of gas turbine machines that are fired with natural gas compliant with current emission standards, General Electric - Power Systems (GE-PS) recently developed low NOx emission versions of such a combustor for their MS-5000 gas turbines, an industrial-type gas turbine with combustors of the canannular type. Without making use of DLN technology, the solution proposed by GE-PS, it has been found, reduces NOx emissions by varying the distribution of air within the combustor by modifying the sizes and patterns of holes in the flame tube (and, thereby, increasing primary air flow) in such a way as to assure lean mixing ratios in the primary combustion zone at maximum load.

This solution, which merely calls for physical modifications to the flame tube, has the advantage of being relatively easy to realize and implement during the course of ordinary gas turbine maintenance. However, because temperature peaks in the primary combustion zone are attenuated, thereby, reducing the reaction rate in the diffusion flame, it can also cause increased production of unburned or un-combusted matter. In addition, since the geometry of the combustion system remains relatively constant, it is not possible for the retention time to be increased.

OBJECTS AND SUMMARY OF THE INVENTION

It is, therefore, an object of the present invention to provide a combustor for diffusion flame gas turbines that utilizes an optimal distribution of air and fuel in the primary combustion zone so as to lower substantially the NOx emissions relative to conventional combustors.

Another object of the present invention is to provide a combustor that is suitable for retrofitting to a diffusion flame gas turbine for operation within the power range 15 and 24 Mwe, that has a modest to low impact on the machine, and upon being applied to it, that maintains its original encumbrance, without the necessity of modifying the control system or the fuel supply of the machine.

According to one aspect of the present invention, there is provided a diffusion flame combustor for a gas turbine, which comprises a flame tube that delimits a combustion chamber. The flame tube has a fuel injector unit mounted at one end with its other end connected to a duct that conveys the combustion gases to the turbine. The flame tube is coaxially mounted inside a generally tubular container that communicates with the discharge casing of an air compressor and, together with the tube, defines a space for the combustion air. The injector unit comprises an injector head facing generally into the combustion chamber and is provided with at least one fuel gas injection nozzle, wherein the fuel gas injection nozzle comprises an air-gas premixing duct into which the fuel gas is introduced. The duct has an inlet section that communicates with the air space and has a radial-fin air swirler arranged upstream of the point at which the fuel gas enters the premixing duct. A plurality of passages are provided along the premixing duct for introduction of the fuel gas.

In this manner, the present invention increases the presence of air in the primary combustion zone and realizes a partially premixed air-fuel stream to be exposed on the flame front in such a way as to limit temperature peaks, which are among the principal factors promoting the formation of thermal NOx. Moreover, the production of unburned matter-that would naturally increase in the diffusion flame due to attenuation of the primary flame temperature-is limited by the effects of the premixing.

BRIEF DESCRIPTION OF THE DRAWINGS

A specific, illustrative combustor for diffusion flame gas turbines in accordance with the present invention, is described below with reference to the accompanying drawings, in which.

DETAILED DESCRIPTION OF THE PREFERRED EMBODIMENTS

Figure 1:
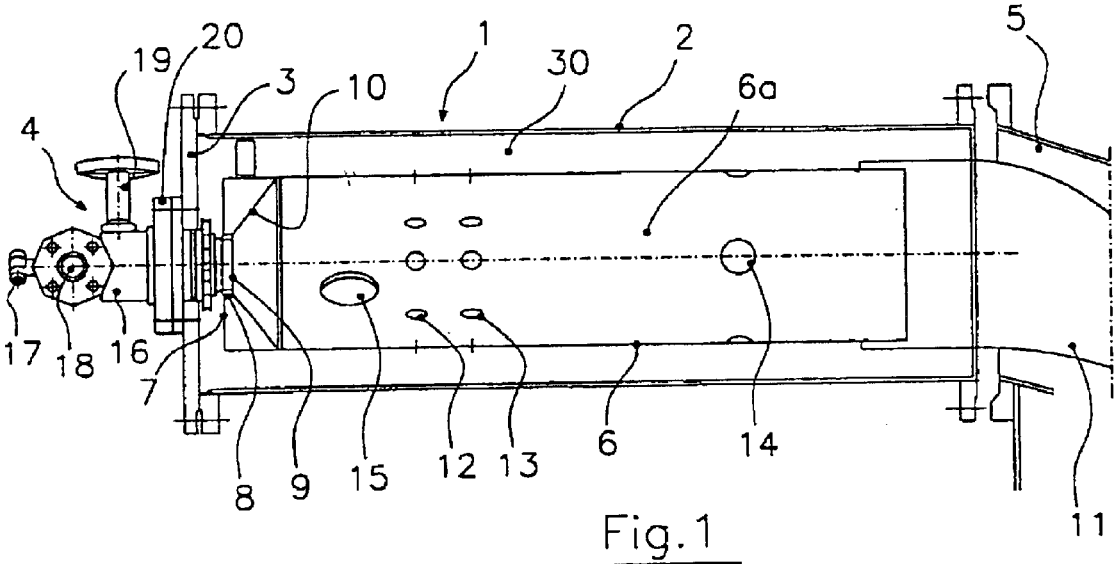
FIG. 1 shows a combustor assembly, in accordance with one aspect of the present invention.

Referring now to the drawings and, more particularly, to FIGS. 1-6, there is shown generally a low NOx emission diffusion flame combustor for gas turbines or the like, according to various aspects of the present invention. According to one embodiment, illustrated generally in FIG. 1, a generic combustor unit 1 of a gas turbine is shown, which comprises an outer tubular container 2 closed at one end by a cover 3, at the center of which an injector unit 4 is affixed or mounted. The other end of tubular container 2 communicates with a discharge box 5 of a combustion air compressor (not shown). A flame tube 6 arranged coaxially with tubular container 2 delimits a combustion chamber 6*a* closed at one end by a calibrated plate 7. The plate is uniformly perforated and has, at its center, a ferrule 8 for engaging head 9 of the injector unit. Notably, the combustor, in accordance with the present invention, is particularly suitable for retrofitting to industrial-type gas turbines with combustors of the can-annular type, such as the MS-5000 gas turbines of GE-PS.

Figure 4:
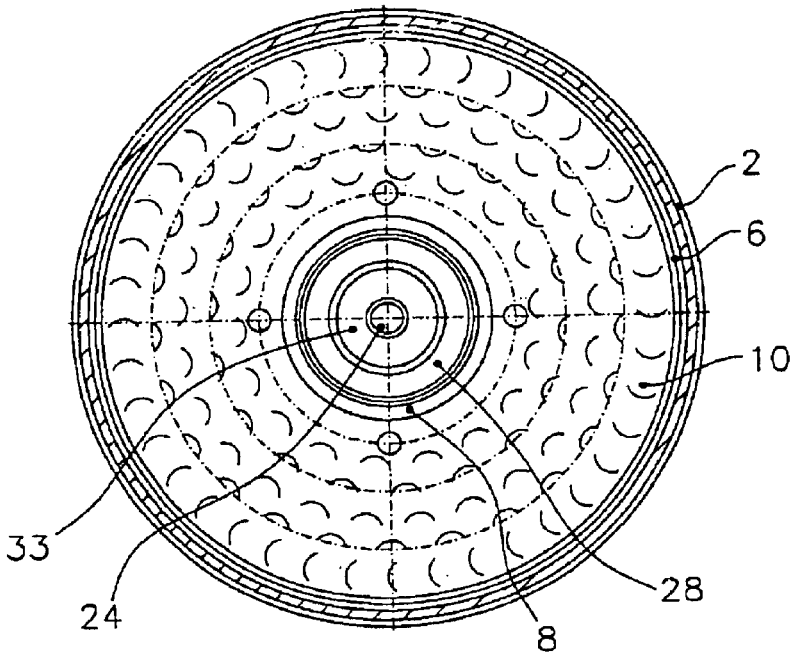
FIG. 4 is a front elevational view of the injector unit of FIG. 3 from inside the combustion chamber.
Figure 2:
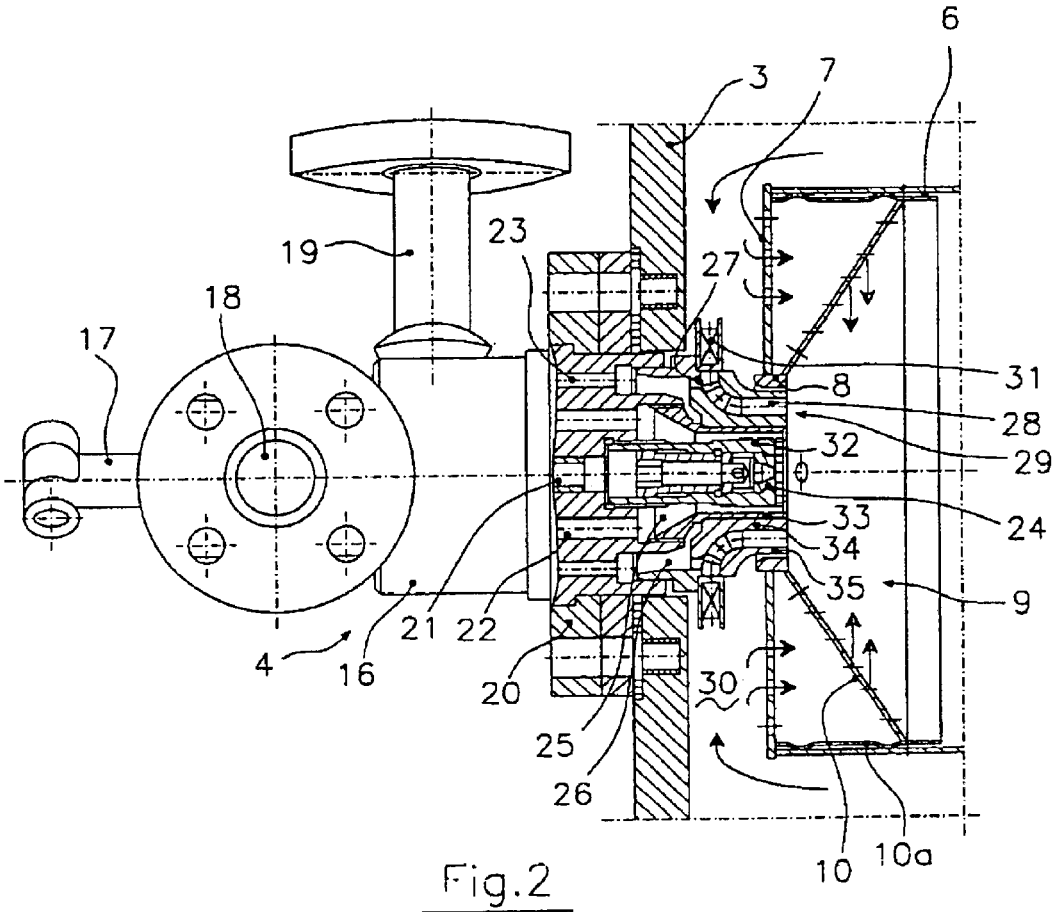
FIG. 2 is a sectional view of an injector unit of a combustor assembly, in accordance with the present invention.

As shown in FIG. 2, a wall 10, preferably in the form of a truncated cone, extends from ferrule 8. The wall is connected to a sleeve 10*a* coaxial with flame tube 6, effectively capping combustion chamber 6*a*. As illustrated in FIG. 4, the surface of wall 10 is provided with uniformly distributed raised cross-cuts for creating passages for the combustion air. The other end of flame tube 6 engages a conveyor duct 11 for feeding the gas turbine (also not shown). Along flame tube 6, which delimits the combustion chamber, there are provided primary holes 12, secondary holes 13 and dilution holes 14 for the combustion air, which flows from discharge box 5 and into an air space 30 between the flame tube and the tubular container. A flame conduit 15 is also provided for joining the combustion chambers of adjacent combustor units so as to be in communication with one another.

As set forth in greater detail in FIGS. 2 and 4, injector unit 4 includes a body 16 having a nozzle 17 for liquid fuel, a nozzle 18 for atomization air, and a nozzle 19 for gaseous fuel. The injector unit also has a flange 20 for connecting the unit to cover 3 of outer tubular container 2. Inside body 16 a central duct 21 is provided for the liquid fuel, around the duct, an inner bundle of ducts 22 is supplied for the atomization air, and an outer bundle of ducts 23 is provided for the gaseous fuel. Head 9 of the injector unit comprises a centrally arranged atomizer nozzle 24 for the fuel and joined coaxially to central duct 21. A chamber 25, where ducts 22 collect the atomization air, is desirably provided outside nozzle 24, the air being injected in a conventional manner using radial canals in a zone immediately downstream of nozzle 24 on the end plane and at generally right angles to an axis of the combustor.

Gas ducts 23, on the other hand, lead into a more outwardly annular chamber 26 communicating through respective passages 27 with an annular premixing chamber 29 situated within a gas injector 29. In greater detail, as best seen in FIG. 2, the atomizer nozzle is contained coaxially within a tubular body 33 that is integral with body 16 of the injector unit and, together with the unit, delimits chamber 25 for the atomization air. Gas injector 29, in turn, comprises an inner flange element 34 mounted to the outside of tubular body 33 and an outer flange element mounted to ferrule 8, which together define annular gas duct 28.

At an inlet end of annular duct, which is in communication with space 30 for the combustion air, a radial swirler 31 is provided, upstream of gas passages 27, for causing the combustion air to become turbulent and, thus, facilitates mixing of combustion air and gas in premixing, annular gas duct 28.

Annular premixing duct 28 comprises a radial part (the swirler being situated at the entry thereto) and an axial part (the parts being joined by a curved portion generally devoid of sharp edges). In addition, the duct has a cross section that gradually decreases in size toward the outlet end of combustion chamber 6*a*. More particularly, the section at the output end of duct 28 is reduced to between about 20% and about 28% of the section at the input end. This configuration is advantageous in making it possible to achieve uniform premixing and, thereby, prevent formation of ring vortices that can cause potentially harmful oscillation phenomena within the machinery.

In the illustrated embodiment the radial swirler has twelve (12) fins with a swirl angle of about 30° and handles a quantity of air equal to within a range of 9% and 12% of the total combustion air. Twelve gas passages 27, each having a diameter of 4.5 mm, are provided and spaced evenly about a circumference situated in proximity to the outlet end of the swirler.

Although the present invention is shown and described in connection with a selected number of gas injection passages, it will be appreciated that a greater number of passages may be utilized (up to 40 have been found preferable), giving consideration to the purpose for which the present invention is intended. In addition, while as the swirler fins may vary in both number and inclination, it is considered desirable that the fins be of the radial type.

Figure 3:
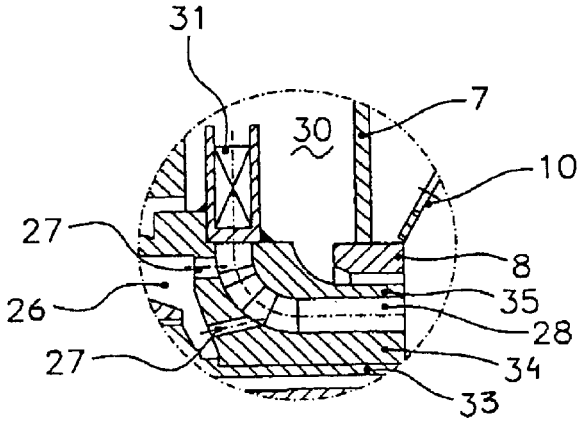
FIG. 3 is a detailed view of a premixing duct of a combustor assembly, according to another aspect of the present invention.

As shown in FIG. 3, gas injection passages 27 may be distributed on two or more circumferences in such a way as to subdivide the air input into a series of successive phases. This is not only advantageous, but may even become necessary to avoid pre-ignition or flash-back problems with machines operating at a high compression ratio (temperature of combustion air greater than about 330° C.) or when the walls of duct 28 become very hot.

Use of a part of the combustion air as air to be premixed with the gas in the injector implies a corresponding reduction in dilution air and, therefore, a consequent re-sizing of dilution holes 14 on flame tube 6, which have to be re-designed in both section and number to minimize the "traversing quality factor" at the entry to the turbine blades.

In the combustor, according to the present invention, the air used to control temperature in the primary combustion zone and the configuration of the combustor assures formation of a primary combustion zone that, on average, is lean and homogeneously premixed to obtain very low NOx levels. As a result, the equivalence factor in the primary combustion zone is $\Phi$=0.7–0.85 rather than about $\Phi$=1 as with traditional combustion. Flame stabilization is obtained by appropriately designing the angle of the radial blades so as to create a recirculation zone downstream of the injector that permits ignition at low load, followed by gradual increase in both speed and load at regular running conditions. Optimum values of the force and extent of the recirculation zone are the result of optimal relations between the momentum of air drawn in through the radial swirler and flowing in the narrowing duct, and the momentum of the passing through the primary holes.

Hence, the combustor, in accordance with the invention, advantageously provides the following:

- reliable and uniform distribution of air and fuel upon entry to the combustor using a strong swirling action to reduce NOx formation;
- optimized distribution of combustion air for greater operational flexibility with maximum flame stability and minimal CO production compared to that achieved using water or steam injection;
- a stable primary recirculation zone useful for fast ignition, so that existing ignition systems may be utilized; and
- integration with water injection systems for further lowering of NOx and CO emissions to comply with future emission standards (0.06–0.09 kg/Mcal).

Figure 5:
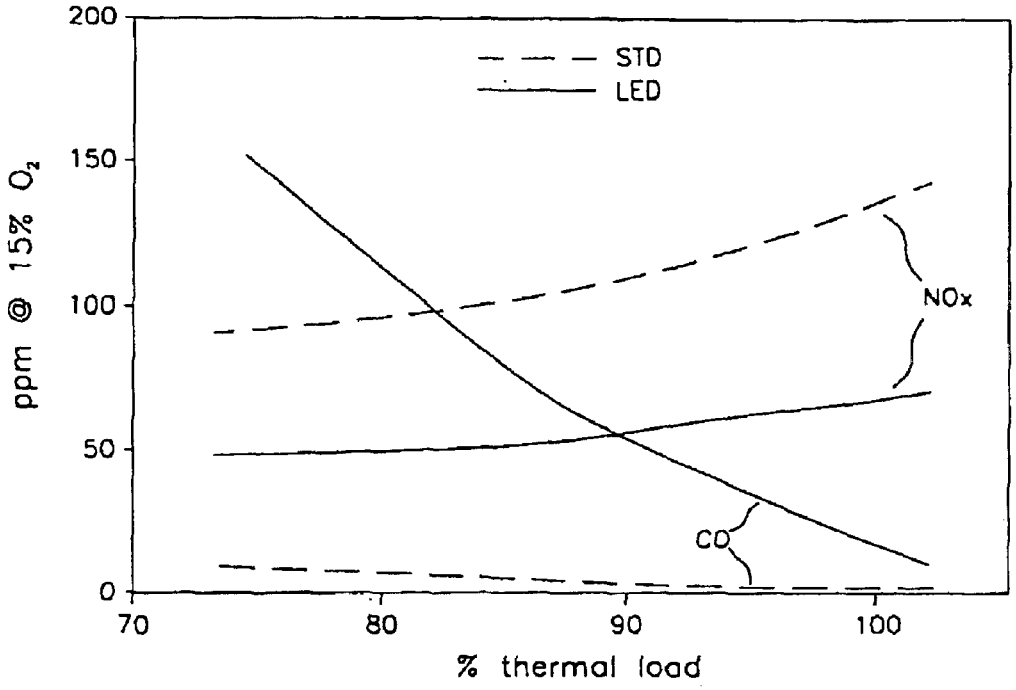
FIG. 5 is a graph that compares emissions of a conventional combustor (STD) with those of a combustor (LED), in accordance with the present invention.
Figure 6:
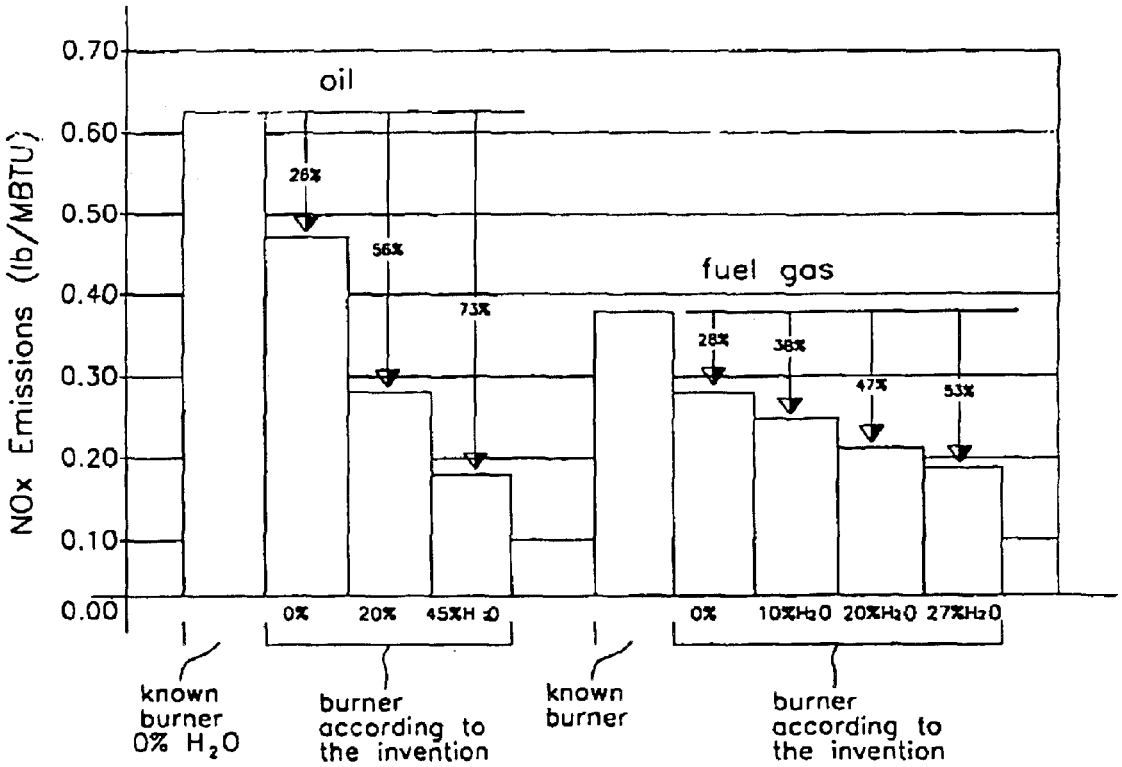
FIG. 6 is a graph illustrating reduction in NOx emissions under various operating conditions that can be obtained using a combustor, according to the present invention, and compares them with emissions from a conventional diffusion flame combustor.

More particularly, as demonstrated by the graphs shown in FIGS. 5 and 6, at dry operating conditions it is now possible to achieve 50% reduction in the NOx emissions with minimal modifications to the machine, and then further reduce NOx emissions to 65% by adding a water injection system to the machine.

While optimization of the combustor, in accordance with the present invention, is based on operation with natural gas, it can also be advantageously employed with liquid fuels, though as can be seen from FIG. 6, the obtainable NOx reduction levels with liquid fuels may not be as favorable as in the case of gas operation.

It will be appreciated that, when the invention is applied to larger can-annular combustors, the size of the combustor may be appropriately varied in scale in accordance with the principle of proportionality and for power levels greater than those indicated herein, and that further appreciable reductions in the NOx emissions may be obtained using water injection.

Various modifications and alterations to the present invention may be appreciated based on a review of this disclosure. These changes and additions are intended to be within the scope and spirit of the invention as defined by the following claims.

What is claimed is:

1. A diffusion flame combustor for a gas turbine comprising a flame tube that delimits a combustion chamber, said flame tube having a fuel injector unit mounted at one end with its other end connected to a duct that conveys the combustion gases to the turbine, said flame tube being coaxially mounted inside a generally tubular container that communicates with the discharge casing of an air compressor and, together with said tube, defines a space for said combustion air, said injector unit comprising an injector head facing generally into said combustion chamber and being provided with at least one fuel gas injection nozzle, wherein the fuel gas injection nozzle comprises an air-gas premixing duct into which the fuel gas is introduced, said duct having an inlet section that communicates with said air space and being provided with a radial-fin air swirler arranged upstream of the point at which the fuel gas enters said premixing duct, and a plurality of passages being provided along said premixing duct for introduction of the fuel gas, said passages being arranged into two axially concentric rows in order to subdivide introduction of the fuel gas into the combustion air into two successive phases.

2. The combustor set forth in claim 1, wherein said fuel injection nozzle has a generally annular form and said injector head comprises a liquid fuel nozzle centrally positioned with respect to said gas injection nozzle.

3. The combustor set forth in claim 1, wherein the outlet section of the pre-mixing duct is reduced to between -20% and 28% of the inlet section of the duct.

4. The combustor set forth in claim 1, wherein said premixing duct is formed by coaxial and mutually spaced flanges, including an internal flange and an external flange, integral with the body of the injector unit, said passages for the fuel gas being arranged generally along the internal flange.

5. The combustor set forth in claim 1, wherein said premixing duct consists of a radial part, said swirler being arranged at the inlet end thereof, and an axial part, said parts being joined by a curved portion generally devoid of sharp edges.

* * * * *